US006167228A

United States Patent [19]

German et al.

[11] Patent Number: 6,167,228

[45] Date of Patent: Dec. 26, 2000

[54] DEVELOPMENT SYSTEM WITH SPLIT FUNCTION DEVELOPMENT ROLLS

[75] Inventors: Kristine A. German, Webster; Stephen P. Hoover, Penfield; Robert W. Phelps, Victor; Dale R. Mashtare, Bloomfield; Christopher Snelling, East Rochester; Darryl L. Pozzanghera, Rochester, all of N.Y.; Michael J. Price, Randolph, Mass.

[73] Assignee: Xerox Corporation, Stamford, Conn.

[21] Appl. No.: 09/438,208

[22] Filed: Nov. 12, 1999

[51] Int. Cl.[7] ..... G03G 15/09

[52] U.S. Cl. ..... 399/267; 399/269; 399/270

[58] Field of Search ..... 399/267, 266, 399/290, 291, 269, 270; 347/140

[56] References Cited

U.S. PATENT DOCUMENTS

| | | | |
|---|---|---|---|
| 4,267,797 | 5/1981 | Huggins | 399/269 |
| 4,292,387 | 9/1981 | Kanbe et al. | 430/102 |
| 4,297,972 | 11/1981 | Hwa | 399/269 |
| 4,436,055 | 3/1984 | Yamashita et al. | 399/269 |
| 4,557,992 | 12/1985 | Haneda et al. | 430/122 |
| 4,868,600 | 9/1989 | Hays et al. | 355/259 |
| 5,409,791 | 4/1995 | Kaukeinen et al. | 430/54 |
| 5,911,098 | 6/1999 | Gyotoku et al. | 399/269 X |

*Primary Examiner*—Quana M. Grainger
*Attorney, Agent, or Firm*—Lloyd F. Bean

[57] ABSTRACT

An apparatus for non-interactive, dry powder development of electrostatic Images composed of solid areas and fine lines areas on an imageable surface including a housing containing developer material; a first magnetic roll, spaced a first predefined distance from the image, for transporting the developer material from the housing to develop solid areas of the image, the magnetic roll including an magnetic core and a cylindrical sleeve enclosing and rotating about the magnetic core; and a second magnetic roll, spaced a second predefined distance from the image, for transporting the developer material from the housing to develop fine line areas of the image, the magnetic roll including an magnetic core and a cylindrical sleeve enclosing and rotating about the magnetic core.

14 Claims, 2 Drawing Sheets

DEVELOPMENT SYSTEM WITH SPLIT FUNCTION DEVELOPMENT ROLLS

CROSS REFERENCE

Cross-reference is made to concurrently filed patent applications, D99504 Ser. No. 09/439,123 entitled; APPARATUS AND METHOD FOR NON-INTERACTIVE ELECTROPHOTOGRAPHIC DEVELOPMENT, by Dale R. Mashtare, et al.,D99504Q1 Ser. No. 09/438,212 entitled; APPARATUS AND METHOD FOR NON-INTERACTIVE ELECTROPHOTOGRAPHIC DEVELOPMENT, by Dale R. Mashtare, et al., and D/99504Q2, Ser. No. 09/438,599 entitled, APPARATUS AND METHOD FOR NON-INTERACTIVE ELECTROPHOTOGRAPHIC DEVELOPMENT, by Dale R. Mashtare, et al.

The invention relates generally to an electrophotographic printing machine and, more particularly, to the non-interactive development of electrostatic images.

BACKGROUND OF THE PRESENT INVENTION

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic image on the photoconductive member corresponding to the informational areas contained within the document. After the electrostatic image is formed on the photoconductive member, the image is developed by bringing a developer material into effective contact therewith. Typically, the developer material comprises toner particles bearing electrostatic charges chosen to cause them to move toward and adhere to the desired portions of the electrostatic image. The resulting physical image is subsequently transferred to a copy sheet. Finally, the copy sheet is heated or otherwise processed to permanently affix the powder image thereto in the desired image-wise configuration.

Development may be interactive or non-interactive depending on whether toner already on the image may or may not be disturbed or removed by subsequent development procedures. Sometimes the terms scavenging and non-scavenging are used interchangeably with the terms interactive and non-interactive. Non-interactive development is most useful in color systems when a given color toner must be deposited on an electrostatic image without disturbing previously applied toner deposits of a different color, or cross-contaminating the color toner supplies. This invention relates to such image-on-image, non-interactive development.

U.S. Pat. No. 4,868,600 to Hays et al. discloses a non-interactive development system wherein toner is first developed from a two-component developer onto a metal-cored donor roll and thereafter disturbed into a powder cloud in the narrow gap between the donor roll and an electrostatic latent image existing on the photoreceptor surface. Development fields created between the donor roll core and the electrostatic latent image harvest some of the toner from the cloud onto the electrostatic image, thus developing it without physically disturbing any previously deposited toner layers. In this method the powder cloud generation is accomplished by thin, AC biased wires strung across the process direction and within the development gap. The wires ride on the toner layer and are biased relative to the donor roll core.

U.S. Pat. No. 4,557,992 to Haneda et al. describes a non-interactive magnetic brush development method wherein a two component developer consisting of magnetically soft carrier materials is carried into close proximity to an electrostatic image and caused to generate a powder cloud by the developer motion due, in part, by the inclusion of an AC voltage applied across the gap between the developer sleeve and the ground plane of the electrostatic image. Cloud generation directly from the surfaces of a two component developer avoids many of the problems created by wires. However, in practice such methods have been speed limited by their low toner cloud generation rate.

U.S. Pat. No. 5,409,791 to Kaukeinen et al. describes a non-interactive magnetic brush development method employing permanently magnetized carrier beads operating with a rotating multipole magnet within a conductive and nonmagnetic sleeve. Magnetic field lines form arches in the space above the sleeve surface creating chains of carrier beads which follow these magnetic field lines. The carrier chains are held in contact with the sleeve and spacing between the developer sleeve and the photoreceptor surface is sufficiently large to maintain the carrier bead chains out of direct contact with the photoreceptor. As the core rotates in one direction relative to the sleeve, the magnetic field lines beyond the sleeve surface rotate in the opposite sense, moving chains in a tumbling action, which transports developer material along the sleeve surface. The strong mechanical agitation very effectively dislodges toner particles generating a rich powder cloud, which can be developed to the adjacent photoreceptor surface under the influence of development fields between the sleeve and the electrostatic image. U.S. Pat. No. 5,409,791 is hereby incorporated by reference.

It has been a problem non-interactive development methods to achieve good solid region development while maintaining good fine line development and vice versa. Many non-interactive development methods function by generating a powder cloud in the gap between the photoreceptor and another member which serves as a development electrode. It is generally observed that this gap should be as small as possible, on the order of 0.010 inches or less. Generally, the larger the gap, the larger become certain image defects in the development of fine lines and edges. As examples of these defects: lines do not develop to the correct width, lines near solid areas are distorted, and the edges of solids are softened, especially at corners. It is understood that these defects are the result of lateral components of the electric field lines occurring due to the charge patterns existing on the image-wise discharged photoreceptor. Electrostatic field lines emanating from the photoreceptor surface reach up from the latent electrostatic image patterns of lines and at the edges of solid areas and arch back toward the adjacent photoreceptor regions. These lateral components of the electric field lines result in displacement from the intended pathway of the charged toner particles and in incomplete development of the latent electrostatic images. Defects due to the electrostatic field arches are less serious in interactive two component development subsystems because toner particles can be delivered through these field arches by carrier particles. Nor are they an issue in interactive single component development because a strong, cross-gap AC field is superposed which impart sufficient toner particle velocity toward the photoreceptor surface to overcome the aforementioned field arch patterns.

SUMMARY OF THE INVENTION

The present invention obviates the problems noted with achieving good solid region development while maintaining good fine line development, by providing an apparatus for non-interactive, dry powder development of electrostatic Images composed of solid areas and fine lines areas on an imageable surface including a housing containing developer material; a first magnetic roll, spaced a first predefined distance from the image, for transporting the developer material from the housing to develop the bulk of the required toner mass to, for example, solid areas of the image, the magnetic roll including a magnetic core and a cylindrical sleeve enclosing and rotating about the magnetic core; and a second magnetic roll, spaced a second predefined distance from the image, for transporting the developer material from the housing to complete the required toner development of fine line and edge areas of the image, the magnetic roll including a magnetic core and a cylindrical sleeve enclosing and rotating about the magnetic core.

DESCRIPTION OF THE INVENTION

Figure 1:
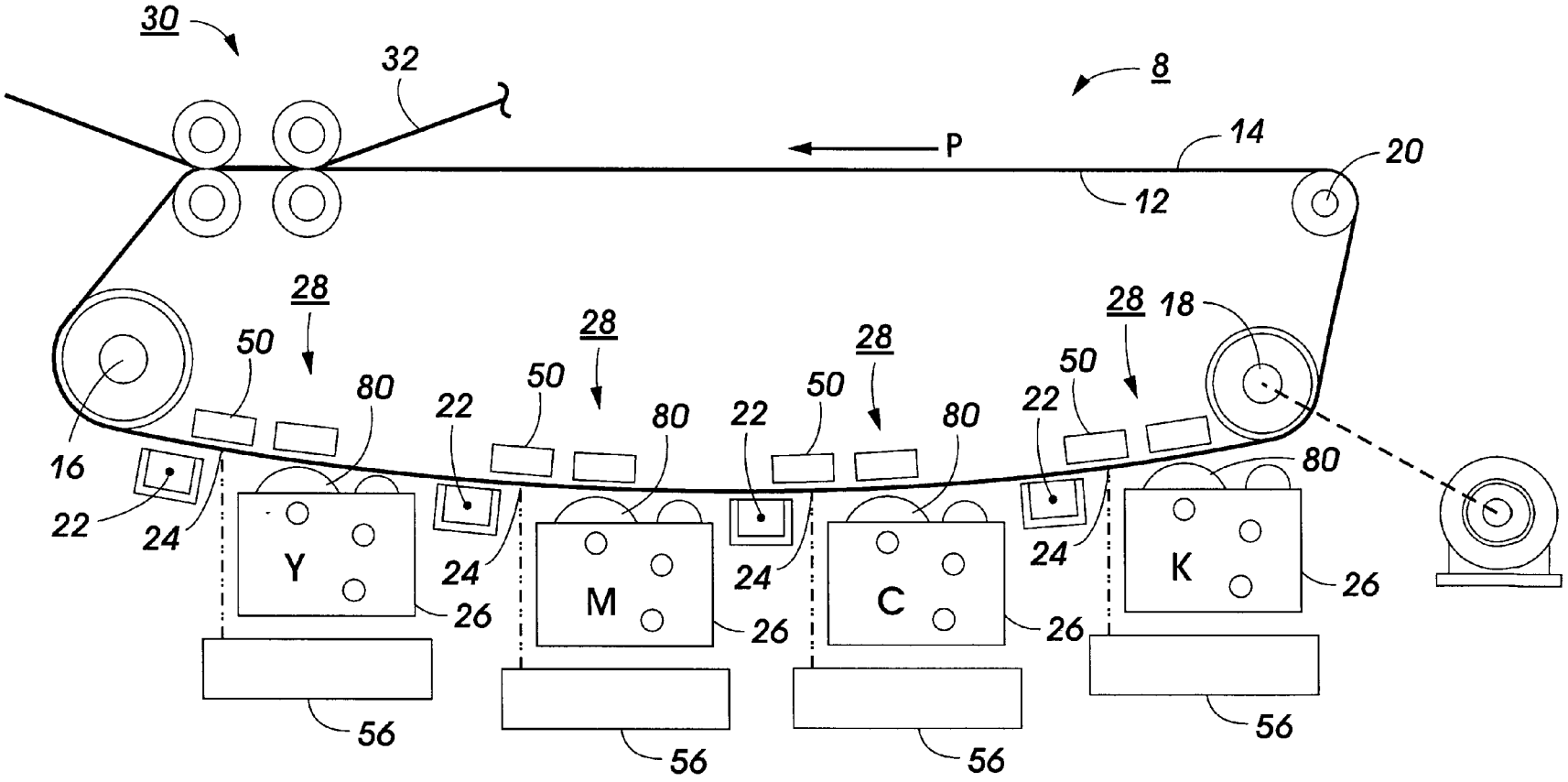
FIG. 1 is a side view, in section, of a four color xerographic reproduction machine incorporating the non-interactive developer of the present invention.

Referring to FIG. 1 of the drawings, there is shown a xerographic type reproduction machine 8 incorporating an embodiment of the non-interactive development system of the present invention, designated generally by the numeral 80. Machine 8 has a suitable frame (not shown) on which the machine xerographic components are operatively supported. As will be familiar to those skilled in the art, the machine xerographic components include a recording member, shown here in the form of a translatable photoreceptor 12. In the exemplary arrangement shown, photoreceptor 12 comprises a belt having a photoconductive surface 14. The belt is driven by means of a motorized linkage along a path defined by rollers 16, 18 and 20, and those of transfer assembly 30, the direction of movement being counterclockwise as viewed in FIG. 1 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the electrostatic image created on photoconductive surface 14 is developed by toners of the appropriate color; and transfer and detack corotrons (not shown) for assisting transfer of the developed image to a suitable copy substrate material such as a copy sheet 32 brought forward in timed relation with the developed image on photoconductive surface 14 at image transfer station 30. In preparation for the next imaging cycle, unwanted residual toner is removed from the belt surface at a cleaning station (not shown).

Following transfer, the sheet 32 is carried forward to a fusing station (not shown) where the toner image is fixed by pressure or thermal fusing methods familiar to those practicing the electrophotographic art. After fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A laser diode raster output scanner (ROS) 56 generates a closely spaced raster of scan lines on photoconductive surface 14 as photoreceptor 12 advances at a constant velocity over shoe 50. A ROS includes a laser source controlled by a data source, a rotating polygon mirror, and optical elements associated therewith. At each exposure station 24, a ROS 56 exposes the charged photoconductive surface 14 point by point to generate the electrostatic image associated with the color separation to be generated. It will be understood by those familiar with the art that alternative exposure systems for generating the electrostatic images, such as print bars based on liquid crystal light valves and light emitting diodes (LEDs), and other equivalent optical arrangements could be used in place of the ROS systems such that the charged surface may be imagewise discharged to form an electrostatic image of the appropriate color separation at each exposure station.

Developer station 26 includes a developer housing 44 in which a toner dispensing cartridge (not shown) dispenses toner particles downward into a sump area occupied by the auger.

Continuing with the description of operation at each developing station 26 includes a developing members 41 and 42 which are disposed in predetermined operative relation to the photoconductive surface 14 of photoreceptor 12, the length of developing member 80 being equal to or slightly greater than the width of photoconductive surface 14, with the functional axis of developing members parallel to the photoconductive surface and oriented at a right angle with respect to the path of photoreceptor 12. Advancement of each developing members carries the developer blanket into the development zone in proximal relation with the photoconductive surface 14 of photoreceptor 12 to develop the electrostatic image therein.

A suitable controller is provided for operating the various components of machine 8 in predetermined relation with one another to produce full color images.

Figure 2:
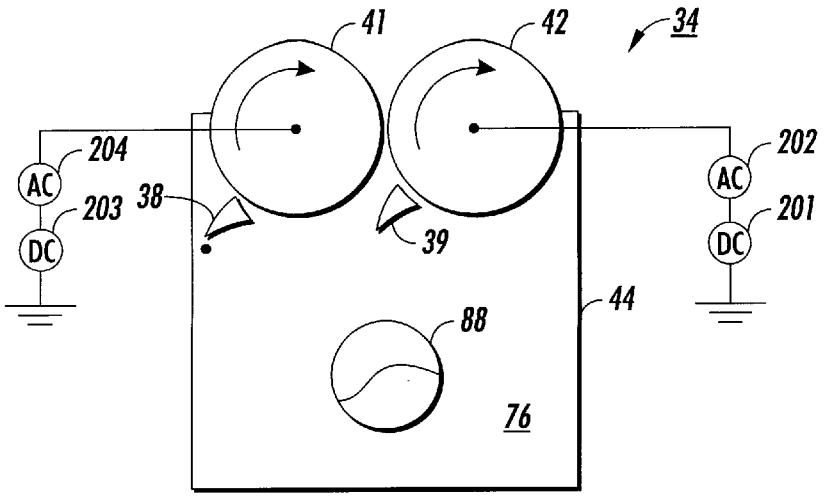
FIG. 2 is an enlarged side view of the developer unit of the present invention.
Figure 3:
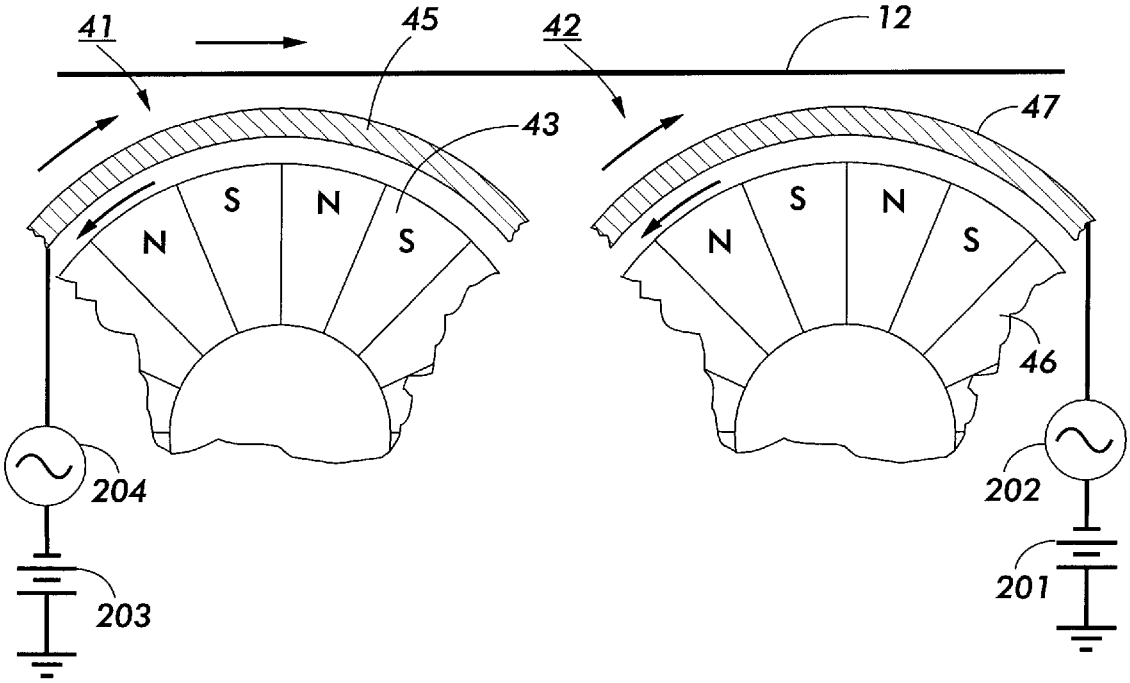
FIG. 3 is an enlarged view of the developer roll shown in FIG. 2.

Referring now to FIGS. 2 and 3 in greater detail, developing station 26 includes a housing 44 defining a chamber 76 for storing a supply of developer material therein. Housing 44 includes a pair of donor members 41 and 42, each donor member comprises an interior rotatable harmonic multipole magnetic assembly 43 and 46 and an outer sleeve 45 and 47. The sleeves can be rotated in either the "with" or "against" direction relative to the direction of motion of the photoreceptor belt 10. Similarly, the magnetic assembly can be rotated in either the "with" or "against" direction relative to the direction of motion of the sleeve 45. Blade 38 and 39 are placed in near contact with the rotating donor members 41 and 42 to trim the height of the developer bed. A cleaning blade (not shown) is placed in contact with the rotating donor members 41 and 42 to continuously remove developer from the donor members 41 and 42 for return to the developer chamber 76. Donor member 41 has a DC power source 203 and an AC power source 204 electrically attached thereto. Donor member 42 has an AC power source 202 and a DC power source 201 electrically attached thereto.

In operation donor member 41 function is to primary developed solid areas of the latent image. Donor member 41 is spaced between 0.020" and 0.050" from the photoreceptor. A DC voltage by supply 203 is applied to insure background regions of the latent electrostatic image are not developed. For example, in Discharge Area Development (DAD) images the DC voltage is set to 100 to 500 volts in according to photoreceptor charge and discharge voltages. For, Charge Area Development (CAD) images voltage is set just above the residual voltage of the photoreceptor about 50 to 200 volts. Interactivity is reduced by using low momentum toner i.e. minimizing the applied AC voltage; and by maintaining a relatively large spacing between donor member 41 and photoreceptor.

Donor member 42 primary function is to develop remaining fine lines and edges by reducing fringe field effects by employing a close photoreceptor to donor member spacing and a low toner bed height. Since large solid areas are develop by donor member 41 thereby neutralizing a major portions of the charge areas of the latent image. This enables improved developability of the fine lines and edge details to be developed by donor member 42. Interactivity is reduce by having a lower toner incident rate; and by keeping toner momentum low by reducing fringe field effects.

For example the development system of the present invention can be setup as follows. For donor member 40 it is desired to have a toner bed height between 0.015" to 0.045", this can be accomplished by configuring the pole spacing of the magnetic assembly to give the desire bed height or blade 38 could be employed to give the desire bed height. The AC frequency for supply is selected to provide maximum development below interactively which is 1 Khz to 4 Khz. Donor member 42 has a desired bed height that is 0.005" to 0.020", this can be accomplished by configuring the pole spacing of the magnetic assembly to give the desire bed height or blade 38 could be employed to give the desire bed height. The AC frequency for supply is selected to provide development for fine lines and edges is 2 Khz to 10 Khz.

The above description outlines only a few broad strokes that are likely to produce beneficial mid-course adjustments in the development process to help achieve high-fidelity, non-interactive development. There are, in fact, several other separate optimization that may also prove useful. Some examples are: the strength and number of poles of the magnetic roll, the magnetic roll speed, the sleeve speed and direction, the size and magnetic characteristics of the carriers bead, and the toner size and tribo.

It should be noted that, even without significantly differentiating the functions of the two rolls, there are inherent benefits in using a two roll housing design compared to using only a single roll design. By effectively doubling the width of the development nip, the individual rolls do not need to be pushed as hard to get the same performance as a single roll. For example, the counter charge created as toner leaves the bed creates additional constraints for achieving high performance. Since the counter charge would be distributed over two rolls, the reduced counter charge density in each nip would relax those constraints. Likewise, lead edge/trail edge effects could be balanced by operating one roll in an against mode and the other roll in a width mode.

The invention has been described in detail with particular reference to a preferred embodiment thereof, but it will be understood that variations and modifications can be effected within the spirit and scope of the invention as described hereinabove and as defined in the appended claims.

What is claimed is:

1. In a development system for developing a latent image being composed of solid areas and fine line areas on an imageable surface with developer material comprising:

a housing containing developer material;

a first magnetic roll, spaced a first predefined distance from said image, for transporting said developer material from said housing to develop primarily solid areas of said image, said magnetic roll including a magnetic assembly and a cylindrical sleeve enclosing and rotating about said magnetic assembly;

a second magnetic roll, spaced a second predefined distance from said image, said second predefined distance being substantially less than said first predefined distance, for transporting said developer material from said housing to develop primarily fine line areas of said image, said magnetic roll including a magnetic assembly and a cylindrical sleeve enclosing and rotating about said magnetic assembly; and means for biasing said first magnetic roll with a DC and AC bias and means for biasing said second magnetic roll with an AC and DC bias, said DC applied to said first magnetic roll to insure background regions of the latent electrostatic image are not developed.

2. The development system according to claim 1, wherein said first predefined distance is between 0.020" and 0.050" and said second predefined distance is between 0.005" and 0.020".

3. The development system of claim 1, wherein said biasing means for said first magnetic roll has a frequency between 1 Khz and 4 KHz.

4. The development system of claim 1, wherein said biasing means for said second magnetic roll has a frequency between 2 Khz and 12 KHz.

5. In a development system for developing a latent image being composed of solid areas and fine line areas on an imageable surface with developer material comprising:

a housing containing developer material;

a first magnetic roll, spaced a first predefined distance from said image, for transporting said developer material from said housing to develop primarily solid areas of said image, said magnetic roll including a magnetic assembly and a cylindrical sleeve enclosing and rotating about said magnetic assembly;

a second magnetic roll, spaced a second predefined distance from said image, said second predefined distance being substantially less than said first predefined distance, for transporting said developer material from said housing to develop primarily fine line areas of said image, said magnetic roll including a magnetic assembly and a cylindrical sleeve enclosing and rotating about said magnetic assembly; said first magnetic roll has a toner bed height of 0.015" and 0.045" and said second magnetic roll has a toner bed height 0.005" to 0.020"; and means for adjusting toner bed height on said first and second magnetic roll.

6. The development system of claim 5, wherein said adjusting means includes a trim blade.

7. The development system of claim 5, wherein said adjusting means includes said magnetic assembly of said second magnetic roll having a smaller pole spacing than said magnetic assembly of said second magnetic roll.

8. Apparatus for non-interactive, dry powder development of electrostatic images composed of solid areas and fine line areas on an imageable surface comprising:

a housing containing developer material;

a first magnetic roll, spaced a first predefined distance from said image, for transporting said developer material from said housing to develop primarily solid areas of said image, said magnetic roll including a magnetic assembly and a cylindrical sleeve enclosing and rotating about said magnetic assembly;

a second magnetic roll, spaced a second predefined distance from said image, said second predefined distance being substantially less than said first predefined distance, for transporting said developer material from said housing to develop primarily fine line areas of said image, said magnetic roll including a magnetic assembly and a cylindrical sleeve enclosing and rotating about said magnetic assembly; and means for biasing said first magnetic roll with a DC and AC bias and means for biasing said second magnetic roll with an AC and DC bias, said DC applied to said first magnetic roll to insure background regions of the latent electrostatic image are not developed.

9. The apparatus according to claim 8, wherein said first predefined distance is between 0.020" and 0.050" and said second predefined distance is between 0.005" and 0.020".

10. The apparatus of claim 8, wherein said biasing means for said first magnetic roll has a frequency between 1 Khz and 4 KHz.

11. The apparatus of claim 8, wherein said biasing means for said second magnetic roll has a frequency between 2 Khz and 12 KHz.

12. Apparatus for non-interactive, dry powder development of electrostatic images composed of solid areas and fine line areas on an imageable surface comprising:

a housing containing developer material;

a first magnetic roll, spaced a first predefined distance from said image, for transporting said developer material from said housing to develop primarily solid areas of said image, said magnetic roll including a magnetic assembly and a cylindrical sleeve enclosing and rotating about said magnetic assembly;

a second magnetic roll, spaced a second predefined distance from said image, said second predefined distance being substantially less than said first predefined distance, for transporting said developer material from said housing to develop primarily fine line areas of said image, said magnetic roll including a magnetic assembly and a cylindrical sleeve enclosing and rotating about said magnetic assembly; said first magnetic roll has a toner bed height of 0.015" and 0.045" and said second magnetic roll has a toner bed height 0.005" to 0.020"; and means for adjusting toner bed height on said first and second magnetic roll.

13. The apparatus of claim 12, wherein said adjusting means includes a trim blade.

14. The apparatus of claim 12, wherein said adjusting means includes said magnetic assembly of said second magnetic roll having a smaller pole spacing than said magnetic assembly of said second magnetic roll.

* * * * *